United States Patent [19]

Fery

[11] Patent Number: 4,640,411

[45] Date of Patent: Feb. 3, 1987

[54] MAILER CONSTRUCTION

[75] Inventor: Guy A. Fery, New York, N.Y.

[73] Assignee: Floating Sky, Inc., New York, N.Y.

[21] Appl. No.: 669,148

[22] Filed: Nov. 7, 1984

Related U.S. Application Data

[63] Continuation-in-part of Ser. No. 449,361, Dec. 13, 1982, Pat. No. 4,567,982, which is a continuation-in-part of Ser. No. 346,441, Feb. 8, 1982, Pat. No. 4,434,889.

[51] Int. Cl.[4] ..... B65D 75/20; B65D 77/00

[52] U.S. Cl. ..... 206/216; 383/2; 206/232; 206/424; 206/616; 206/449

[58] Field of Search ..... 383/2, 62; 206/216, 206/232, 424, 492, 616, 806, 494, 449, 425

[56] References Cited

U.S. PATENT DOCUMENTS

| | | | |
|---|---|---|---|
| 2,088,232 | 7/1937 | Cumming | 383/62 |
| 2,799,391 | 7/1957 | Eisner | 206/232 |
| 2,861,735 | 11/1958 | Faltin | 383/2 |
| 2,934,255 | 4/1960 | McDuffie | 206/616 |
| 3,380,644 | 4/1968 | D'Alessio | 206/424 |
| 3,445,054 | 5/1969 | Champlin | 206/424 |
| 3,946,867 | 3/1976 | McGuire et al. | 206/424 |
| 4,328,924 | 5/1982 | Neff et al. | 206/616 |
| 4,434,889 | 3/1984 | Fery | 206/216 |
| 4,487,431 | 12/1984 | Kelly | 206/232 |
| 4,492,306 | 1/1985 | Cooper et al. | 206/232 |
| 4,567,982 | 2/1986 | Fery | 206/216 |

FOREIGN PATENT DOCUMENTS

| | | | |
|---|---|---|---|
| 6296 | 1/1980 | European Pat. Off. | 206/424 |

*Primary Examiner*—William Price
*Assistant Examiner*—Brenda J. Ehrhardt
*Attorney, Agent, or Firm*—Wolder, Gross & Yavner

[57] ABSTRACT

A mailer in the form of a receptacle having a base and upstanding sides is foldable into an essentially planar configuration. The receptacle surfaces are adapted for informational indicia, and are provided with means to seal the receptacle in the folded state. The mailer can be used for the transport of materials either within the folded receptacle or the receptacle can be wrapped about an item, such as a catalog, to serve both as a mailer and as a protective cover.

9 Claims, 10 Drawing Figures

MAILER CONSTRUCTION

The present application is a continuation-in-part of application Ser. No. 449,361 filed Dec. 13, 1982, now U.S. Pat. No. 4,567,982 which is a continuation-in-part of Ser. No. 346,441, filed Feb. 8, 1982, now U.S. Pat. No. 4,434,889.

BACKGROUND OF THE INVENTION

The prior application, of which the present is a continuation-in-part, relates to an envelope, mailer, multipage document or other type of printed matter and, in particular, to such a formed paper or other sheet material which construction includes as parts thereof a collapsible container or receptacle which may be opened by the recipient and used in the appropriate manner, as well as an information or message-imparting section.

A typical letter, mailer, magazine, flyer, or card, while indicating to the recipient the concerns, thoughts and interests of the sender, is a device of limited practicality. Soon after receipt by the recipient the construction is often discarded, its message and contents having been duly received and noted by the person to whom it was sent.

In addition, promotional and informational material mailed or offered in the form of printed matter needs to have an element of attractiveness or novelty to grasp the recipient's attention so that the material being presented or offered for the recipient's consideration will be noticed. A utilitarian object, which may be retained and utilized by the recipient for a period of time after receipt, can serve this function and can be further adorned with appropriate indicia to further promote the services or products of the sender.

In the '361 application, a series of mailers including integral receptacles were disclosed. The receptacles were removable from the mailers, to be used in a utilitarian sense to extend the useful life of the construction. The receptacles may be adorned with informational promotional indicia.

In particular, the '361 application disclosed mailer constructions in which the receptacle also functions as an envelope or cover, either for enclosed items or bound printed items such as catalogs or magazines. The present invention represents further improvements of these embodiments.

Accordingly, an object of the present invention to provide an improved mailer having an integral receptacle which extends the useful life of the construction wherein improved means for sealing the construction in the delivery configuration are provided.

A further object of the present invention is to provide an improved mailer whereby the sealing means may be manufactured and included at a lower cost and with greater efficiency than other sealing means.

Yet a further object of the present invention is to provide such an improved mailer for a multipage bound item, such as a catalog, or other item too large to be placed completely within a folded bag envelope, whereby the item may be easily removed from the mailer upon receipt.

SUMMARY OF THE INVENTION

In accordance with the above and other objects the present invention takes the form of a receptacle constructed of a sheet material and which may be folded into a configuration whereby materials may be transported within the folded receptacle. Upon receipt the materials can be removed from the folded receptacle, which is then unfolded and utilized in a conventional manner.

For sheet-type materials, the receptacle is folded into an envelope configuration, and is provided with means to retain it in the folded configuration. Material may be placed within the receptacle prior to folding. Means may be provided to facilitate the opening of the receptacle envelope upon receipt.

For larger items, such as catalogs, the receptacle is folded about the catalog, and serves both as a mailer and as a protective cover. The receptacle includes means for securing the ends of the wrapped receptacle together, and may also include means for securing the wrapped receptacle to the enclosed item. Means are further provided for facilitating opening of the receptacle and removal of the item.

BRIEF DESCRIPTION OF THE DRAWINGS

A complete understanding of the present invention, as well as further objects and features thereof, can be obtained by reference to the following description of preferred, but nonetheless illustrative embodiments of the present invention when taken in conjunction with the annexed drawings, wherein.

DESCRIPTION OF THE PREFERRED EMBODIMENTS

Figure 1:
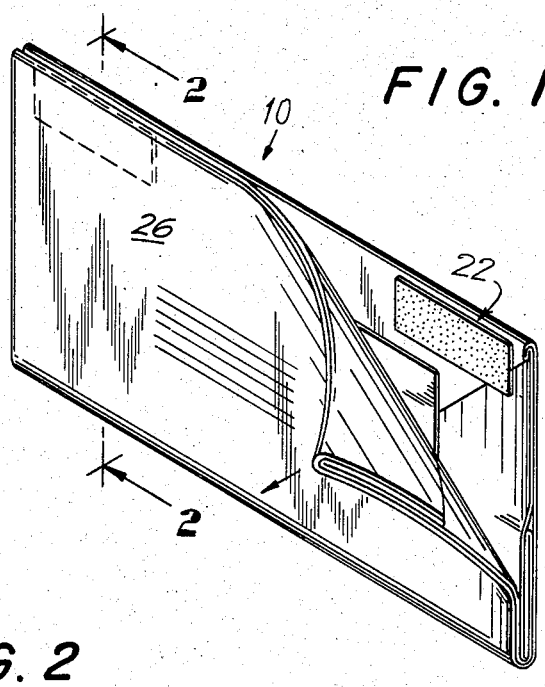
FIG. 1 is a perspective view of a first embodiment showing an envelope construction in which a portion of the receptacle defines an outer surface of the envelope, detailing the improved sealing means.
Figure 2:
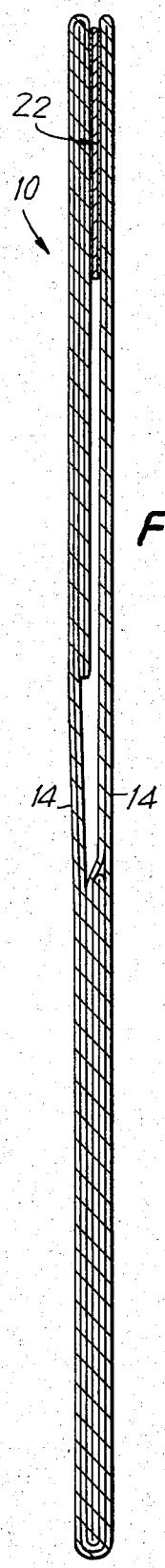
FIG. 2 is a sectional view taken along line 2—2 of FIG. 1.
Figure 3:
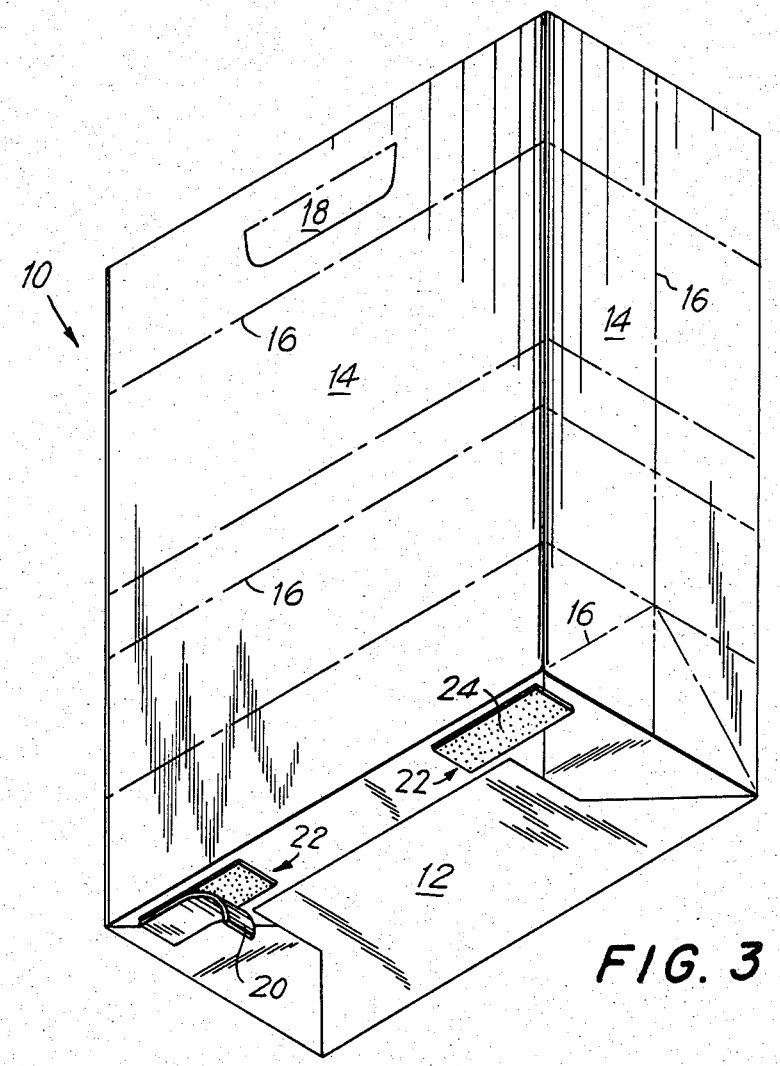
FIG. 3 is a perspective view of the invention showing the receptacle in the open position.

Referring initially to FIGS. 1 through 3, the first embodiment of the invention takes the general form of a combination envelope and receptacle. The envelope/-receptacle is manufactured of an appropriate sheet material, such as paper or cardboard product.

Envelope/receptacle 10 includes a generally flat base 12 and upstanding sides 14, which are provided with appropriate fold lines 16 to allow the container to be collapsed to the essentially planar folded state. Handles 18 may be provided in the form of a die cut portion, or may be constructed of a heavy gauge paper which may be folded inwardly when the receptacle is in the collapsed position.

If formed with a fully die cut portion 18 the resulting opening may be utilized as a window for observation of a portion of material inserted into the receptacle prior to folding. With proper orientation of fold lines 16 the portion of the bag having the window can lie on an outer surface of the construction to permit the information, such as mailing data, to be observed, thus eliminating the need for additional mailing indicia.

Located upon the exterior of receptacle base 12 are adhesive patches 22. The patches 22 may be in the form a sections of dual-side adhesive tape, with the exposed surface 24 being protected by a removable wax or plastic coated release sheet 20.

The receptacle is dimensioned such that it is foldable from the configuration of FIG. 3 to the mailing configuration of FIG. 1, such that patches 22 can contact an upper portion of the construction as shown in FIG. 1, the open top of the receptacle can be folded over to further secure the contents within the receptacle. When the release sheets are removed, the patches may be affixed to the upper receptacle surface, thus retaining the construction in the folded, mailable condition. Outer surface 26 is utilized as the address panel, while the inwardly-folded surfaces may be used for correspondence. In addition, the receptacle may be used to carry additional sheets bearing other written or print material, which may be folded along with the receptacle.

Figure 4:
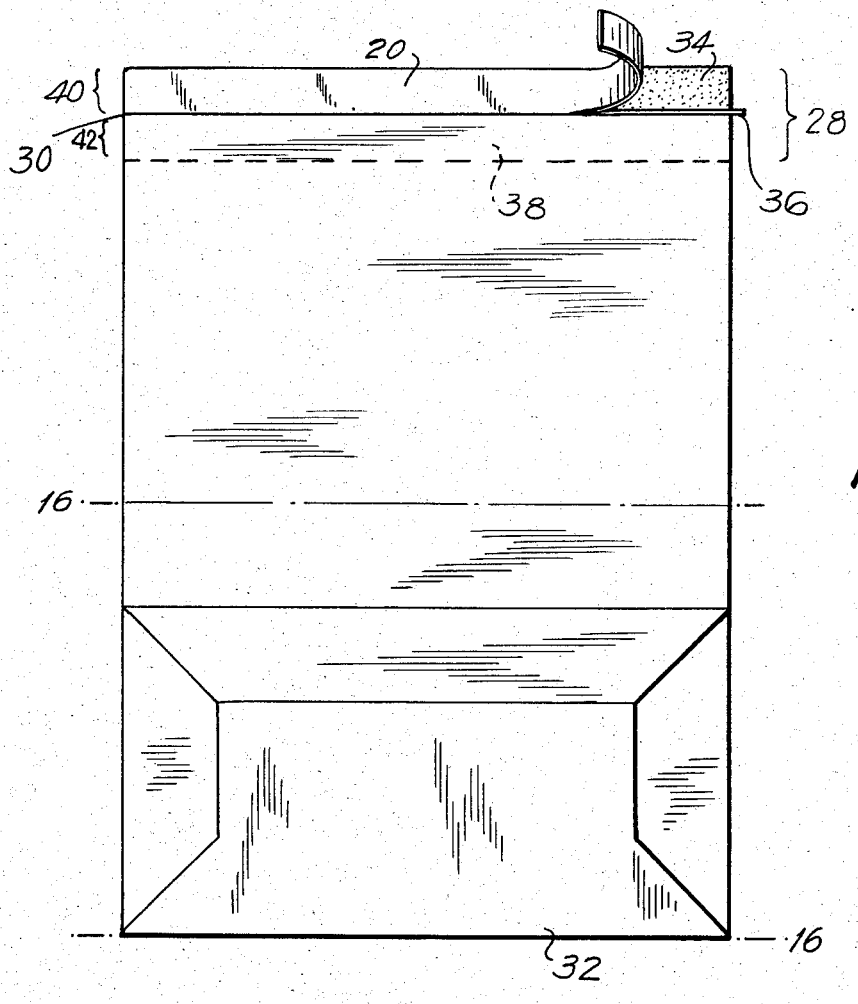
FIG. 4 is a plan view of a second embodiment of the present invention shown in a flat configuration.
Figure 5:
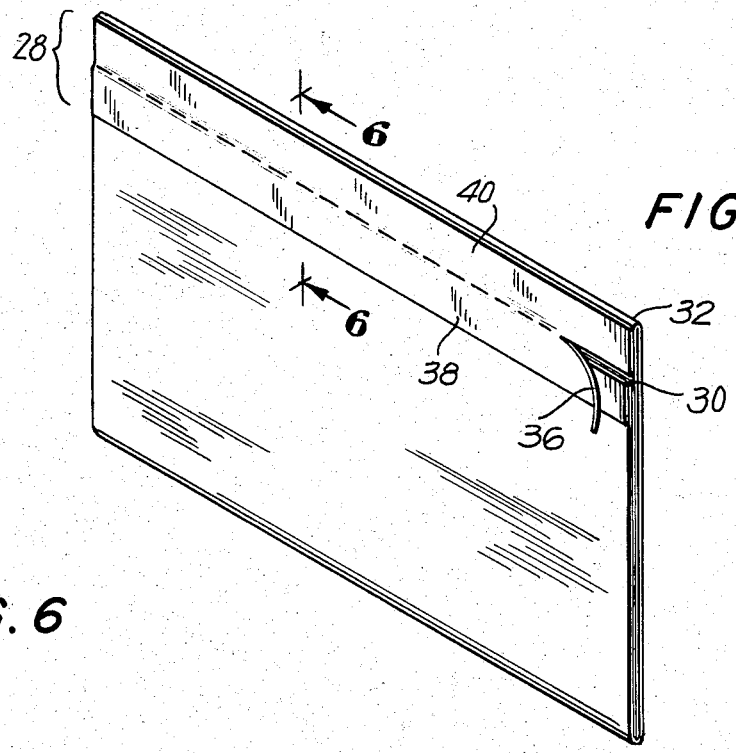
FIG. 5 is a perspective view of the second embodiment in the fully folded and sealed configuration.
Figure 6:
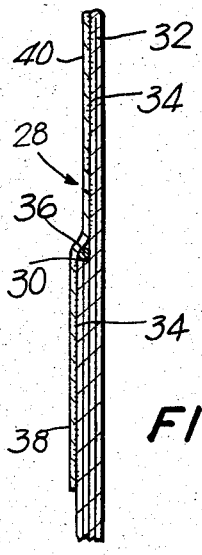
FIG. 6 is a partial sectional view of the embodiment taken along line 6—6 of FIG. 5, further detailing the sealing means of the embodiment.

An alternative embodiment of the invention is depicted in FIGS. 4–6. In that embodiment an adhesive tab 28 is located along an edge 30 of the construction. The fold lines 16 are located such that, when the folded configuration, the upper portion 40 of tab 28 is aligned with an opposed portion 32 of the construction. The adhesive surface 34 of the tab is protected prior to attachment by removable release sheet 20.

Tab 28 may be provided with an embedded tear string 36, which is aligned with the edge 30 of the construction. Tear string 36 is arranged such that its removal after sealing severs the tab, thus allowing the construction to be reopened and unfolded. The precise method of construction of such string is a matter of choice and is well known in the art. Tab 28 itself may be in the form of an adhesive strip, the lower portion 38 of which is affixed to upper receptacle edge 30, while the upper, free portion 40 of the tab is provided with the release paper 20. The two portions 38, 40 may be divided by the tear string 36, which thus also provides a means for alignment of the tab strip along the edge 30. The fold lines 16 may be provided to permit receptacle portion 32 to abut tab portion 40, or, as an alternative, to abut with receptacle edge 30, such that tab portion 40 can be folded over receptacle portion 32.

Figure 7:
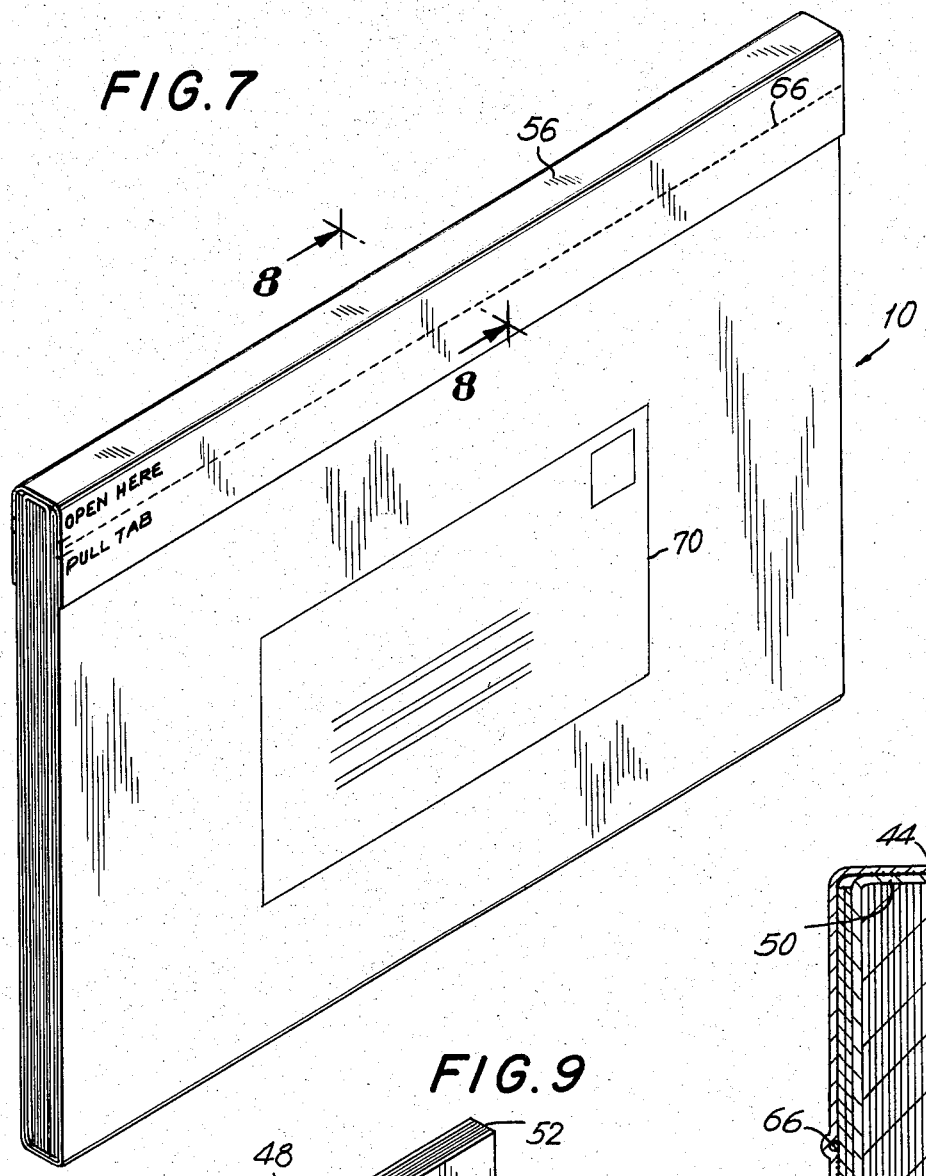
FIG. 7 is a perspective view of a third configuration of the invention used for multi-page bound item, such as a catalog.
Figure 8:
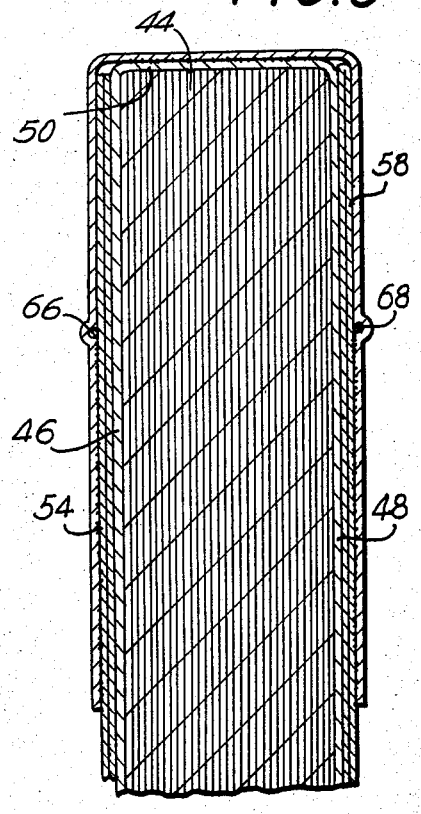
FIG. 8 is a partial sectional view of the embodiment taken along line 8—8 of FIG. 7 detailing the means by which the mailer is sealed.
Figure 9:
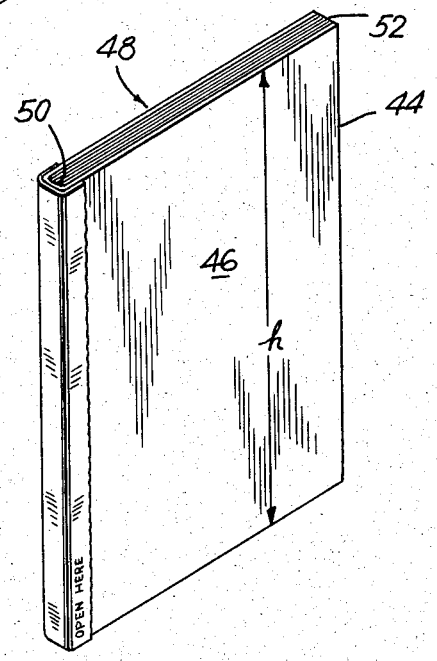
FIG. 9 is a perpective view of the catalog after the mailer is removed.
Figure 10:
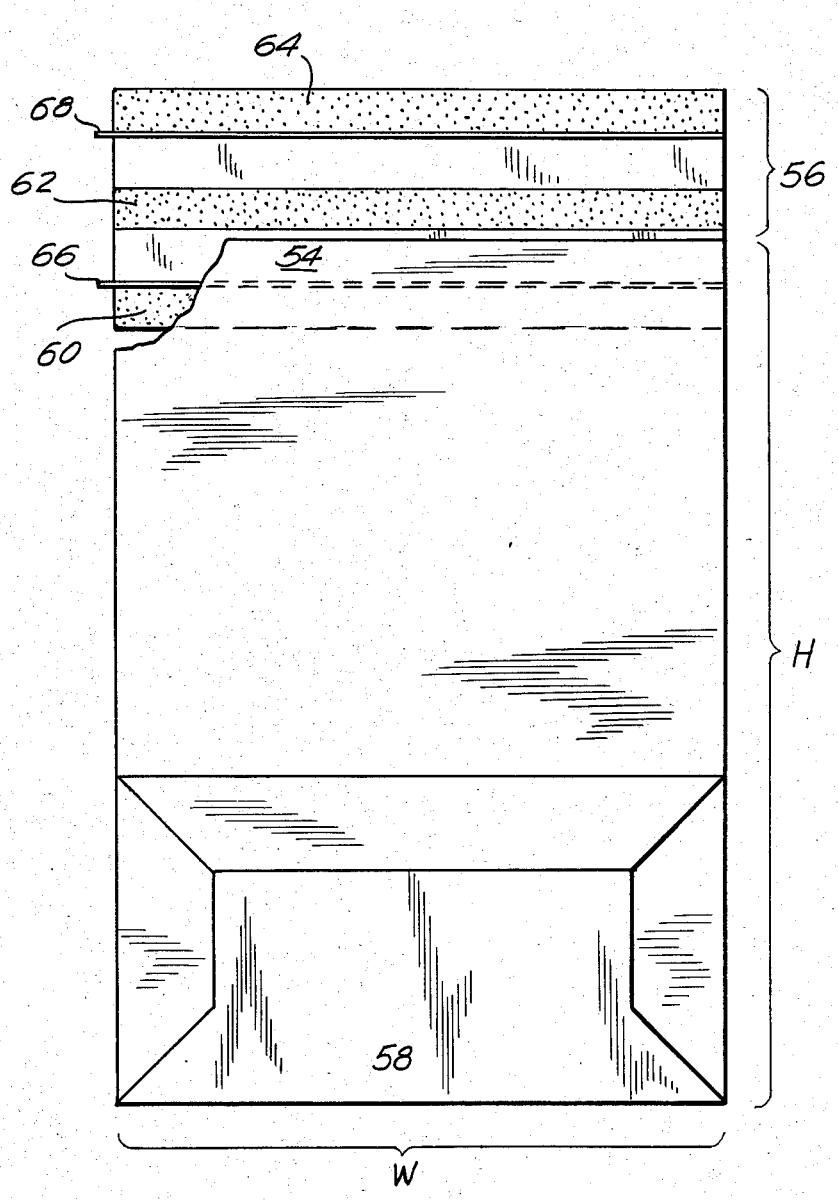
FIG. 10 is a plan view of the embodiment in the pre-folded configuration.

Referring next to FIGS. 7 through 10, the present invention may also be utilized as a protective cover and mailer for items too large to be inserted into the folded bag, such as a catalog or magazine. As seen in FIGS. 7 and 8, flattened receptacle 10 is wrapped around the item, such as catalog 44 having sides 46 and 48, bound spine 50, and exposed page edges 52, such that it encircles the sides 46 and 48 as well as edges 52. The width of the bag W (FIG. 10) is such that it at least covers the height h of the catalog, (FIG. 9), while the height H of the flattened bag is such that it fully surrounds the two sides 46 and 48 as well as edge 52 of the catalog.

Affixed to bag edge 54 is adhesive tab 56, which extends across the width of the bag. Tab 56 is dimensioned to extend across catalog spine 50 and be attachable to opposed edge 58 of the folded receptacle. As detailed in FIG. 10, tab 56 may be provided with adhesive portions 60, 62 and 64 on its inner surface to secure the bag about the enclosed item. The inward edges of portions 60 and 64 are defined by the location of imbedded tear strings 66 and 68, which allow disengagement of the bag 10 from the enclosed catalog 44. Central adhesive portion 62 is dimensioned and located to secure tab 56 and attached receptacle 10 to catalog spine 50 such that the catalog is retained within the folded receptacle during transit. Depending upon the specific means of assembly utilized, adhesive portions 62 and 64 may be provided with release paper covers (not shown) to protect the adhesive portions prior to insertion of the catalog into the folded receptacle and sealing thereof.

Upon wrapping of the receptacle about the catalog and the sealing thereof by means of tab 56, an appropriate mailing label 70 may be applied to an outer surface of the resulting construction. Upon receipt tear strings 66 and 68 are removed, severing tab 56 along their lengths and allowing catalog 44 to be removed. The portion of tab 56 located between tear strings 66 and 68 remain affixed to catalog spine 50. If such remaining portion is considered to be unacceptable an appropriate adhesive may be chosen for adhesive section 62 which would allow the tab section to be removed from the spine. Receptacle 10, which has protected the catalog during the transit process, may then be opened and utilized in a conventional manner. In addition, additional promotional material may have been placed within the receptacle. Such material may also be removed upon receipt.

The constructions of the present embodiments, utilizing integral patches or tabs which need not be folded, allows economies of manufacture. In addition, in the case of the patches, the location of the patches may be varied as required by the dimensions of the construction to accomplish the sealing feature.

It is to be recognized that numerous modifications and adaptations of the invention may be utilized without departing from the spirit of the invention. The scope of the invention therefore, is to be measured by the annexed claims.

What is claimed is:

1. A mailing envelope for a multi-page book having front and back covers joined by a spine, comprising a receptacle having a base and four upstanding sides, said base and sides being formed from a sheet material and being foldable into an essentially planar configuration having a top edge and bottom edge, said folded receptacle being dimensioned to be wrapped about said book such that said top edge is proximate said spine-front cover joint and said bottom edge is proximate said spine-rear cover joint, and a closure strip affixed to said top and bottom edges of said receptacle and extending across said spine, said strip having means to permit separation of said edges such that the receptacle may be removed from the book and opened.

2. The invention of claim 1 wherein said closure strip includes means for affixing the book to said closure strip.

3. The invention of claim 2 wherein said affixation means comprises an adhesive portion of said closure strip.

4. The invention of claim 3 wherein said adhesive portion is composed of a non-permanent adhesive.

5. The invention of claim 2 wherein said separation means comprises at least one imbedded tear string located proximate at least one of said spine-cover joints.

6. The invention of claim 2 wherein said closure strip is affixed to said sides by adhesive.

7. A receptacle adapted and constructed to perform both a storage function and an information-transfer function, comprising a base and four sides terminating in an open top, said base and sides being formed from a sheet material and being folded into an essentially planar configuration, said base being folded and retained between folded over portions of the side walls, the folded structure including exterior sides formed from the sides of said receptacle, portions of said sides adjacent to said open top being folded over and retained between said folded over portions of the side walls said exterior sides of said receptacle providing an essentially flat surface, free of discontinuities upon which an address and other information-transferring indicia may be placed, and at least one adhesive patch on at least one of said base and sides located and arranged to retain the receptacle in said folded planar configuration.

8. The assembly of claim 7 wherein said patches are two in number and are located for adherence between said base and said portions of said sides adjacent said open top.

9. The assembly of claim 8 wherein said patches are formed from a two-sided adhesive tape adhered to at least one of said base and side portions.

* * * * *